United States Patent [19]

Halverstadt et al.

[11] Patent Number: 4,733,796

[45] Date of Patent: Mar. 29, 1988

[54] CIGARETTE PACKAGE

[75] Inventors: Dale A. Halverstadt, Macon, Ga.; Walter L. Tucker, Louisville, Ky.; Josef F. Klingler, Wilmette; James L. Meier, Des Plaines, both of Ill.

[73] Assignee: Brown & Williamson Tobacco Corporation, Louisville, Ky.

[21] Appl. No.: 51,340

[22] Filed: May 18, 1987

[51] Int. Cl.[4] ..... B65D 43/14; B65D 51/04

[52] U.S. Cl. ..... 220/339; 229/160.1

[58] Field of Search ..... 220/339; 229/44 R, 44 CB

[56] References Cited

U.S. PATENT DOCUMENTS

| | | | |
|---|---|---|---|
| 3,327,887 | 6/1967 | Chalmers | 220/339 |
| 3,414,157 | 12/1968 | Wright | 220/339 |
| 4,645,077 | 2/1987 | McLaughlin et al. | 220/339 |
| 4,678,080 | 7/1987 | Nelson | 220/339 |

*Primary Examiner*—George T. Hall

*Attorney, Agent, or Firm*—Charles G. Lamb

[57] ABSTRACT

A cigarette package includes an open topped container for holding a plurality of cigarettes and a cover hinged to the back wall of the container for selectively closing the open top of the container. The top edge of the front wall of the container is lower than the top edge of the back wall of the container and each of the container side walls are notched such that the top edge of the container side walls defining the notch extend from the top edge of the container back wall to the top edge of the container front wall. The cover has a top wall, a front wall, and two side walls. Each of the cover side walls are notched in a complementary shape to the notched portion of the container side walls. The cover is releasably held in a closed position closing the open top of the container by interlocking latches and strikers. The latch is formed in the cover and the striker is formed in the container. The package is fabricated of an impact resistant flexible material.

5 Claims, 5 Drawing Figures

CIGARETTE PACKAGE

BACKGROUND OF THE INVENTION

1. Field of the Invention

The invention relates to packages for cigarettes and the like, and more particularly to packages having integrally formed containers and hinged covers with locks for holding the cover in a closed position over the container.

2. Prior Art

Packages having integral containers and hinged lids or covers with locks for holding the cover in a closed position are known. Examples can be found in U.S. Pat. No. 2,713,368 issued on July 19, 1955 to H. M. Thomas; U.S. Pat. No. 2,777,492 issued on Jan. 15, 1957 to H. M. Kikuchi; U.S. Pat. No. 3,053,382 issued on Sept. 11, 1962 to W. Tschatsch; U.S. Pat. No. 3,223,275 issued on Dec. 14, 1965 to F. L. Rice; U.S. Pat. No. 3,327,887 issued on June 27, 1967 to J. W. Chalmers; U.S. Pat. No. 3,327,888 issued on June 27, 1967 to J. W. Chalmers; U.S. Pat. No. 3,894,655 issued on July 15, 1975 to H. H. Mattheis et al; U.S. Pat. No. 4,098,430 issued on July 4, 1978 to H. H. Mattheis et al; U.S. Pat. No. 4,102,452 issued on July 25, 1978 to M. Sato et al; and U.S. Pat. No. 4,133,449 issued on Jan. 9, 1979 to E. M. Ostrowsky.

SUMMARY OF THE INVENTION

The present invention provides a cigarette package which is particularly well suited to be fabricated of an impact resistant flexible material.

The present invention further provides a cigarette package which is particularly suitable to be manufactured by a molding technique.

More particularly the present invention provides a cigarette package comprising:

(a) a container for cigarettes having a planar bottom wall; a planar back wall extending perpendicularly upwardly from the bottom wall terminating at a top edge; a planar front wall spaced from and substantially parallel to the back wall extending perpendicularly upwardly from the bottom wall terminating at a top edge at a lower elevation than the top edge of the back wall; two spaced apart substantially parallel side walls extending perpendicularly upwardly from the bottom wall and being mutually perpendicular to and integrally joining the front and back walls, each of the side walls being formed with a notched out area at the top end thereof, the edges of the side wall defining the notched out area extending from the side edge of the back wall at the top terminal edge of the back wall to the side edge of the front wall at the top terminal edge of the front wall; the top edge of the back wall, the top edge of the front wall and the edges of each of the side walls defining the notched out area cooperating to define an open container top;

(b) a cover movable from a first position away from the open container top to a second position closing the open container top having a top wall hinged along the rear side edge to the top edge of the back wall of the container; a front wall extending downwardly from the front edge of the top wall a distance substantially equal to the difference in elevation between the top edge of the container back wall and top edge of the container front wall, terminating at a bottom edge; two spaced apart substantially parallel side walls extending perpendicularly downwardly from the cover top wall integrally joined to the side edges of the cover top wall and side edges of the cover front wall, each of the cover side walls being formed with a notched out area at the bottom end thereof complementary in shape and size to the notches formed in the container side walls, the bottom edge of the cover side wall defining the notched out area extending from the side edge of the cover top wall to the side edge of the cover front wall at the bottom terminal edge of the cover front wall wherein when the cover is in the second position the bottom terminal edge of the cover front wall longitudinally abuts the top terminal edge of the container front wall, and the notch defining edges of the cover side walls abut the notch defining edges of the container side walls; and, lock means for releasably holding the cover in the second position.

BRIEF DESCRIPTION OF THE DRAWINGS

The invention will become even more clear upon reference to the following description in conjunction with the accompanying drawings wherein.

DETAILED DESCRIPTION OF THE PREFERRED EMBODIMENT

Figure 1:
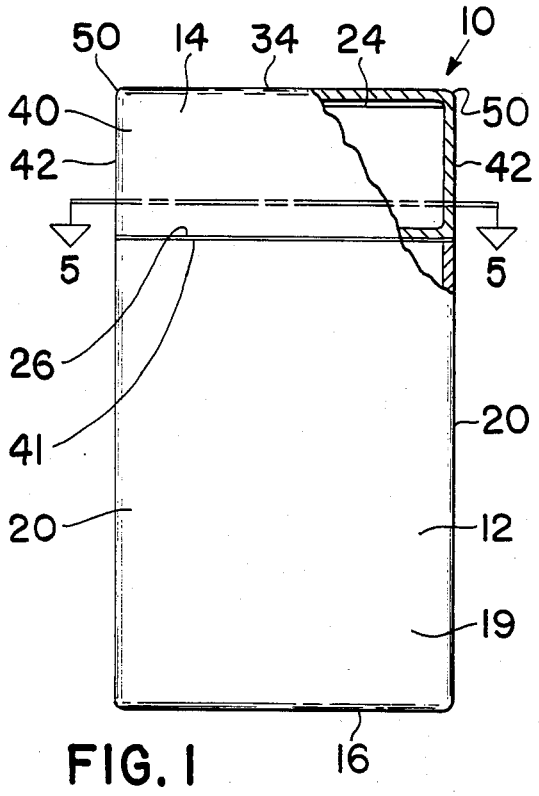
FIG. 1 is a front view of the cigarette package of the invention with the cover in the closed position.

With reference to FIGS. 1 through 4, there is shown a cigarette package, generally denoted as the numeral 10, of the present invention. The package 10 includes an open topped container 12 for holding a plurality of cigarettes (not shown) and a cover 14 for selectively covering and uncovering the open topped container 12.

The container 12 includes a planar bottom wall 16, a planar back wall 18, a planar front wall 19, and two planar parallel side walls 20. The back wall 18 extends perpendicularly upwardly from the bottom wall 16 terminating at a top edge 24. The front wall 19 is spaced from and substantially parallel to the back wall 18 and extends perpendicularly upwardly from the bottom wall 16 terminating at a top edge 26 at an elevation below that of the top terminating edge 24 of the back wall 18. The two mutually parallel side walls 20 extend perpendicularly upwardly from the bottom wall 16 and are also mutually perpendicular to the back wall 18 and front wall 19 integrally connecting to the back wall 18 and front wall 19.

Figure 3:
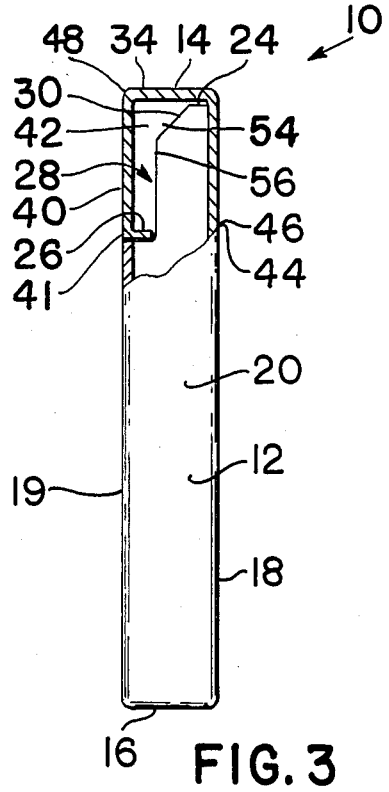
FIG. 3 is a side view of the cigarette package of FIG. 1.
Figure 2:
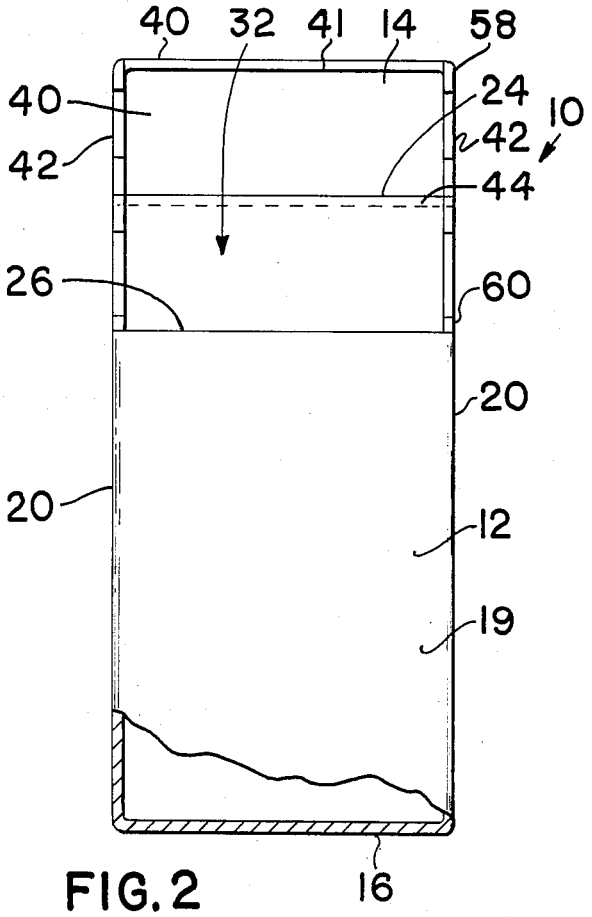
FIG. 2 is a front view of the cigarette package of the invention with the cover in the open position.
Figure 4:
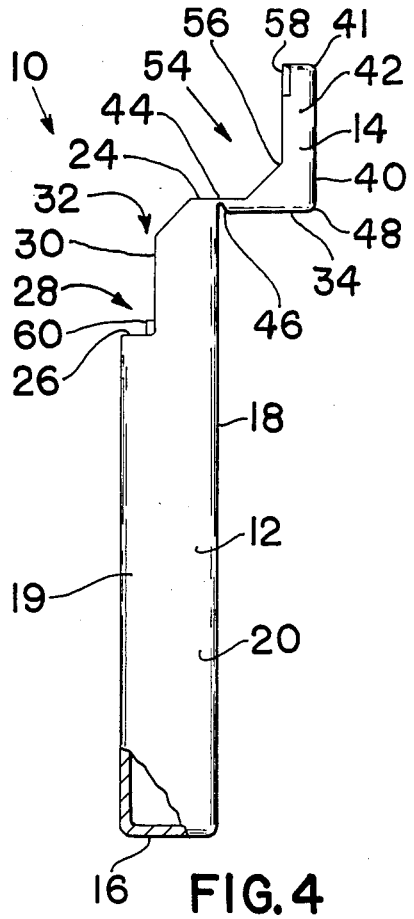
FIG. 4 is a side view of the cigarette package of FIG. 2.

As can be best seen in FIGS. 3 and 4, the two side walls 20 are formed with identical notched out areas 28 at the top ends thereof. The terminating top edge 30 of each side wall 20 defines the notched out area 28 extends from the juncture of the side wall 20 and back wall 18 at the top terminating edge 24 of the back wall 18 to the juncture of the side wall 20 and front wall 19 at the top terminating edge 26 of the front wall 19.

The top edge 24 of the back wall 18, the top edge 26 of the front wall 19 and the top terminating edges 30 of the side walls 20 define the open top 32 of the container 12 therethrough which cigarettes can be removed from the container 12.

The cover 14 includes a planar top wall 34 matching the rectangular shape of the open container top 32, a front wall 40, and two spaced apart parallel side walls 42. The cover 14 is connected to the container 12 by an integral hinge 44 interconnecting the top terminating edge 24 of the container back wall 18 to the rear edge 46 of the cover top wall 34. The cover front wall 40 extends downwardly perpendicularly from the front edge 48 of the cover top wall 34 a distance substantially equal to the difference in the elevations between the terminating top edge 24 of the container back wall 18 and the terminating top edge 26 of the container front wall 19 terminating at a bottom edge 41.

The cover front wall 40 is integral with the cover top wall 34. The cover side walls 42 extend downwardly from the opposite side edges 50 of the cover top wall 34 and are integral therewith and are also integral with the side edge of the cover front wall 40.

As can be best seen in FIGS. 3 and 4, the two cover side walls 42 are formed with identical notched out areas 54 at the top ends thereof. The notched out areas 54 are complementary in shape and size to the notched out areas 28 of the container side walls 20.

When the cover 14 is in the first or closed position (see FIG. 1) the bottom terminal edge 41 of the cover front wall 40 longitudinally abuts the top terminal edge 26 of the container front wall 19, and the terminating bottom edges 56 of the cover side walls 42 longitudinally abut the terminating top edges 30 of the container side walls 20.

Figure 5:
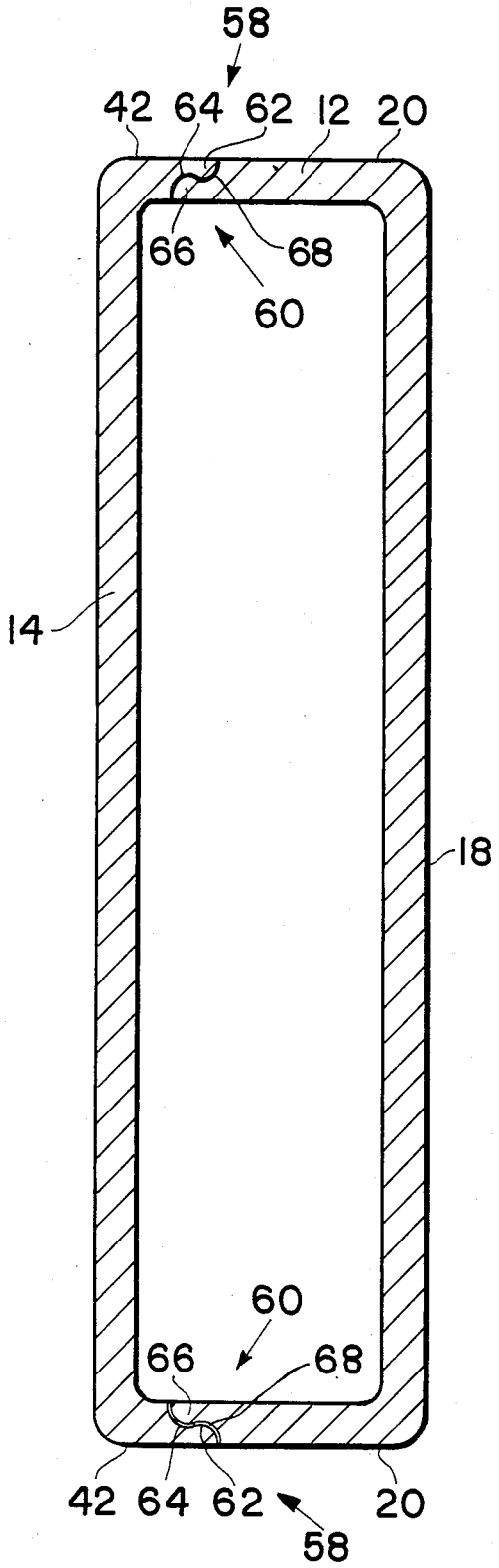
FIG. 5 is an enlarged cross-sectional view of the cigarette package as seen in the direction of arrows 5—5 in FIG. 1.

The package 10 includes lock means for releasably holding the cover 14 in the closed or first position. As shown in FIGS. 2, 3, 4, and 5, the lock means includes latch means 58 associated with the cover 14 and striker means 60 associated with the container 12 for releasable engagement with the latch means 58 when the cover is in the first position. More particularly, the latch means 58 is associated with each of the cover side walls 42 and the striker means 60 is associated with each of the container side walls 20. As shown in FIG. 5, the latch means 58 includes a pair of lips 62 and adjacent grooves 64 formed in the cover side walls 42. The lips 62 and grooves 64 extend longitudinally of the cover side walls 64 and are integral therewith. The striker means 60 includes a pair of lips 66 and adjacent grooves 68 formed in each of the container side walls 20. The lips 62 and grooves 64 face toward each other laterally across the cover 14, and the lips 66 and grooves 68 face away from each other laterally of the container 12. When the cover 14 is in the first position the lips 62 of the latch means 58 are seated in the grooves 68 of the striker means 60, and the lips 66 of the striker means 60 are seated in the grooves 64 of the latch means 58 so that the lips 62 and 64 interfere with each other when the cover is rotated about the hinge 44 from the first position to the second position thusly locking the cover 14 in the first position.

The package 10 is fabricated of a flexible material. Therefore, in order to disengage the lock means, one compresses the container side walls 20 transversely inwardly slightly deforming the side walls 20 until the lips 62 of the latch means 58 are unseated from the grooves 68 of the striker means 60, and the lips 66 of the striker means 60 are unseated from the grooves 64 of the latch means 58 freeing the cover 14 for movement about the hinge 44.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cigarette package comprising:

(a) a container for cigarettes having a planar bottom wall; a planar back wall extending perpendicularly upwardly from the bottom wall terminating at a top edge; a planar front wall spaced from and substantially parallel to the back wall extending perpendicularly upwardly from the bottom wall terminating at a top edge at a lower elevation than the top edge of the back wall; two spaced apart substantially parallel side walls extending perpendicularly upwardly from the bottom wall and being mutually perpendicular to and integrally joining the front and back walls, each of the side walls being formed with a notched out area at the top end thereof, the edges of the side wall defining the notched out area extending from the side edge of the back wall at the top terminal edge of the back wall to the side edge of the front wall at the top terminal edge of the front wall wherein the top edge of the back wall, the top edge of the front wall and the edges of each of the side walls defining the notched out area cooperate to define an open container top; and, (b) a cover movable from a first position away from the open container top to a second position closing the open container top having a top wall hinged along the rear side edge to the top edge of the back wall of the container; a front wall extending downwardly from the front edge of the top wall a distance substantially equal to the difference in elevation between the top edge of the container back wall and top edge of the container front wall, terminating at a bottom edge; two spaced apart substantially parallel side walls extending perpendicularly downward from the cover top wall integrally joined to the side edges of the cover top wall and side edges of the cover front wall, each of the cover side walls being formed with a notched out area at the bottom end thereof complementary in shape and size to the notches formed in the container side walls, the bottom edge of the cover side wall defining the notched out area extending from the side edge of the cover top wall to the side edge of the cover front wall at the bottom terminal edge of the cover front wall wherein when the cover is in the second position the bottom terminal edge of the cover front wall longitudinally abuts the top terminal edge of the container front wall, and the notch defining edges of the cover side walls abut the notch defining edges of the container side walls; and, lock means for releasably holding the cover in the second position.

2. The cigarette package of claim 1, wherein the lock means comprises:

latch means on the cover; and striker means on the container for releasably engaging with the latch means when the cover is in the first position.

3. The cigarette package of claim 2, wherein the latch means is associated with each of the cover side walls;

and, the striker means is associated with each of the container side walls.

4. The cigarette package of claim 3, wherein the latch means comprises a lip and an adjacent groove formed in at least one of the cover side walls; and, the striker means comprises a lip and an adjacent groove formed in at least one of the container side walls; wherein when the cover is in the first position the lip of the latch means is seated in the groove of the striked means, and the lip of the striker means is seated in the groove of the latch means.

5. The cigarette package of claim 4, wherein the striker means comprises a pair of lips and adjacent grooves, each lip and adjacent groove being formed in a different one of the cover side walls, and the lips of the striker means face toward each other laterally of the cover; and, the latch means comprises a pair of lips and adjacent grooves, each lip and adjacent groove being formed in a different one of the container side walls, and the lips of the latch means face away from each other laterally of the container.

* * * * *